US010267330B2

(12) United States Patent
Krishnababu

(10) Patent No.: US 10,267,330 B2
(45) Date of Patent: Apr. 23, 2019

(54) COMPRESSOR AEROFOIL AND CORRESPONDING COMPRESSOR ROTOR ASSEMBLY

(71) Applicant: Siemens Aktiengesellschaft, Munich (DE)

(72) Inventor: Senthil Krishnababu, Lincoln (GB)

(73) Assignee: Siemens Aktiengesellschaft, Munich (DE)

( * ) Notice: Subject to any disclaimer, the term of this patent is extended or adjusted under 35 U.S.C. 154(b) by 287 days.

(21) Appl. No.: 15/315,763

(22) PCT Filed: Jun. 3, 2015

(86) PCT No.: PCT/EP2015/062373
§ 371 (c)(1),
(2) Date: Dec. 2, 2016

(87) PCT Pub. No.: WO2015/197328
PCT Pub. Date: Dec. 30, 2015

(65) Prior Publication Data

US 2017/0102004 A1 Apr. 13, 2017

(30) Foreign Application Priority Data

Jun. 25, 2014 (EP) ..... 14173942

(51) Int. Cl.
*F01D 5/20* (2006.01)
*F04D 29/38* (2006.01)
(Continued)

(52) U.S. Cl.
CPC ..... *F04D 29/388* (2013.01); *F01D 5/20* (2013.01); *F04D 29/324* (2013.01); *F04D 29/34* (2013.01); *F04D 29/522* (2013.01)

(58) Field of Classification Search
CPC .... F04D 29/388; F04D 29/386; F04D 29/384; F04D 29/38; F04D 29/324; F04D 29/34; F04D 29/522; F01D 5/20
See application file for complete search history.

(56) References Cited

U.S. PATENT DOCUMENTS 4,875,831 A 10/1989 Fetiveau
5,503,527 A 4/1996 Lee et al.
(Continued)

FOREIGN PATENT DOCUMENTS

EP 0317432 A1 5/1989
EP 1013878 B1 12/2004
(Continued)

OTHER PUBLICATIONS

International Search Report for PCT application No. PCT/EP2015/062373.
(Continued)

*Primary Examiner* — Jacob Amick
(74) *Attorney, Agent, or Firm* — Beusse Wolter Sanks & Maire

(57) ABSTRACT

A compressor aerofoil for a turbine engine, having a suction surface wall and a pressure surface wall meeting at a leading edge and trailing edge, a tip plate extends between the walls and has a first and a second tip rib extending therefrom. At least one of the first and second tip rib has a height extending from the tip plate. A camber line is defined as passing through the leading and trailing edge and the camber line length is from the leading to trailing edge along the tip plate. The first and second tip rib define a slot along the camber line of the aerofoil. The first tip rib is located a distance L1 from the leading towards the trailing edge and the second tip
(Continued)

rib is located a distance L2 from the leading edge, the distances L1 and L2 greater than 1% of the camber line length.

15 Claims, 6 Drawing Sheets

(51) Int. Cl.
*F04D 29/32* (2006.01)
*F04D 29/34* (2006.01)
*F04D 29/52* (2006.01)

(56) References Cited

U.S. PATENT DOCUMENTS

| | | | | |
|---|---|---|---|---|
| 2005/0232771 | A1* | 10/2005 | Harvey | F01D 5/20 416/97 R |
| 2010/0290920 | A1 | 11/2010 | Liang | |
| 2012/0100000 | A1* | 4/2012 | He | F01D 5/20 416/223 R |

FOREIGN PATENT DOCUMENTS

| | | | | |
|---|---|---|---|---|
| EP | 2378075 | A1 * | 10/2011 | F01D 5/20 |
| SU | 779591 | A1 | 11/1980 | |
| WO | 2005106207 | A1 | 11/2005 | |
| WO | 2011038966 | A1 | 4/2011 | |

OTHER PUBLICATIONS

CN Office Action dated Jun. 28, 2017, for CN patent application No. 201580034442.0.

* cited by examiner

FIG 5 A-A
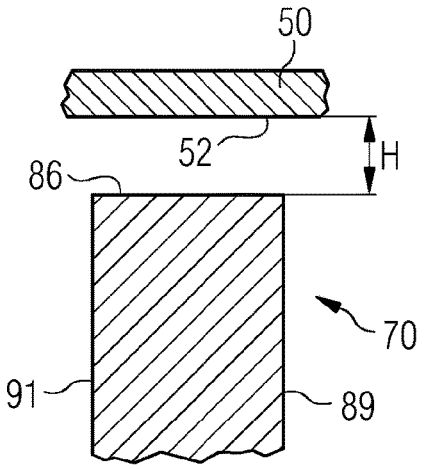
FIG 6 B-B
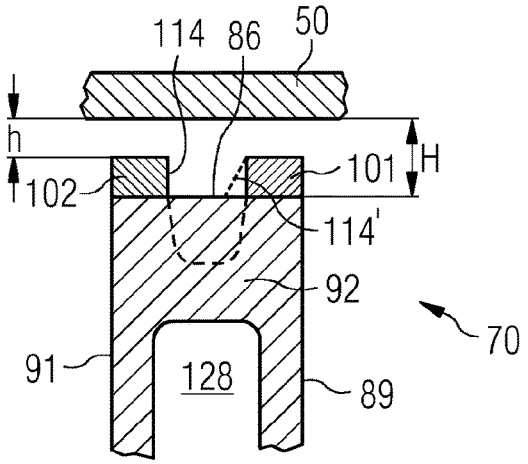
FIG 7 C-C
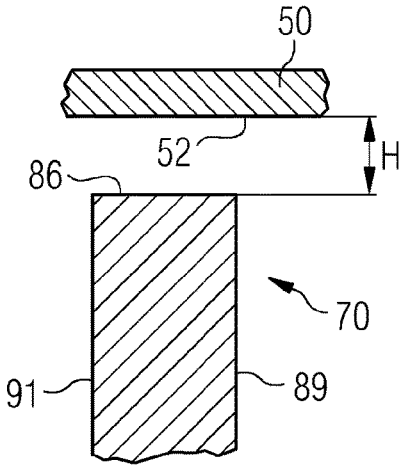
FIG 8
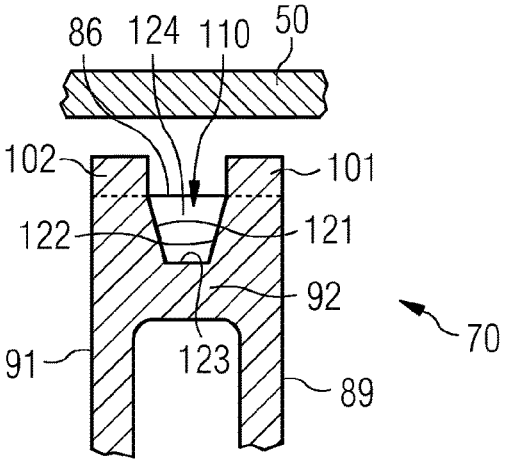

COMPRESSOR AEROFOIL AND CORRESPONDING COMPRESSOR ROTOR ASSEMBLY

CROSS REFERENCE TO RELATED APPLICATIONS

This application is the US National Stage of International Application No. PCT/EP2015/062373 filed Jun. 3, 2015, and claims the benefit thereof. The International Application claims the benefit of European Application No. EP14173942 filed Jun. 25, 2014. All of the applications are incorporated by reference herein in their entirety.

FIELD OF INVENTION

The present invention relates to an un-shrouded compressor aerofoil and in particular a configuration of a tip of the compressor aerofoil to minimise aerodynamic losses. The compressor aerofoil is either a rotor blade or a stator vane. Also the present invention relates to a compressor rotor assembly which includes a casing and an annular array of the compressor aerofoils defining a tip gap therebetween. The casing is a stator casing surrounding an annular array of the compressor blade aerofoils or a rotor drum surrounded by an annular array of the compressor vane aerofoils.

BACKGROUND OF INVENTION

A compressor of a gas turbine engine comprises rotor components, including rotor blades and a rotor drum, and stator components, including stator vanes and a stator casing. The compressor is arranged about a rotational axis with a number of alternating rotor blade and stator vane stages as is well known and each stage comprises an aerofoil. The efficiency of the compressor is influenced by the running clearances or radial tip gap between its rotor and stator components. The radial gap or clearance between the rotor blades and stator casing and between the stator vanes and the rotor drum is set to be as small as possible to minimise over tip leakage of working gases, but sufficiently large to avoid significant rubbing that can damage components.

The pressure difference between a pressure side and a suction side of the aerofoil causes the working gas to leak through the tip gap. This flow of working gas or over-tip leakage generates aerodynamic losses due to its viscous interaction within the tip gap and with the mainstream working gas flow particularly on exit from the tip gap. This viscous interaction causes loss of efficiency of the compressor stage and subsequently reducing the efficiency of the gas turbine engine.

EP 2 378 075 A1 discloses a turbine blade having a tip that carries winglets which project laterally from the turbine blade at the radially outer end of the suction surface and pressure surface respectively. A gutter is formed in the winglet's tip and the position and direction of the gutter exit provides control over mixing losses associated with the return of gases from the gutter to the main working gas flow.

EP 1 013 878 B1 discloses a turbine blade including an airfoil having pressure and suction sidewalls joined together at leading and trailing edges and extending from a root to a tip plate. Twin ribs extend outwardly from the tip plate between the leading and trailing edges and are spaced laterally apart to define an open-top tip channel therebetween. Each of the tip ribs has an airfoil profile for extracting energy from combustion gases flowable around the turbine blade. The pressure side tip rib is stepped away from the main airfoil pressure surface and extends from the leading edge of the airfoil.

However, two main components to the over tip leakage flow have been identified. A first component that originates near a leading edge of the aerofoil at the tip and which forms a tip leakage vortex and a second component that is created by leakage flow passing over the tip from the pressure side to the suction side. This second component exits the tip gap and feeds into the tip leakage vortex thereby creating still further aerodynamic losses.

The turbine blade winglet configuration of EP 2 378 075 A1 aims to prevent the formation of the tip leakage vortex by virtue of the winglets overhanging the pressure and suction surfaces and the winglet being present at the leading edge of the aerofoil.

The tip rib configuration of EP 1 013 878 B1 aims to extract work from the main working gas flow by diverting a portion of the working gas flow into its channel and turning the flow from the leading edge to the trailing edge. The presence of the pressure side rib at the leading edge also aims to prevent the formation of the tip leakage vortex.

SUMMARY OF INVENTION

One objective of the present invention is to divert a portion of the tip leakage vortex flow to prevent that portion being part of the tip leakage vortex that spills off the aerofoil tip. Thereby the present invention seeks to reduce the strength of the tip leakage vortex and therefore increase efficiency. Another objective is to reduce the interaction of the tip leakage vortex and the leakage flow passing over the tip from the pressure side to the suction side. Another object of the present invention is to increase the efficiency of compressor aerofoils.

To address the problems of known compressors and turbines described above and for the advantages described below, there is provided a compressor aerofoil for a turbine engine, the compressor aerofoil comprises a suction surface wall having a suction surface and a pressure surface wall having a pressure surface, the suction surface wall and the pressure surface wall meet at a leading edge and a trailing edge, a tip plate extends between the suction surface wall and the pressure surface wall and has a first tip rib and a second tip rib extending therefrom, the tip plate has a tip surface, the first tip rib has a first height R1 and the second tip rib has a second height R2 extending from the tip surface, a camber line is defined as passing through the leading edge and the trailing edge and the camber line length is from the leading edge to the trailing edge along the tip plate, the first tip rib and the second tip rib define a slot generally arranged along the camber line of the aerofoil, the first tip rib begins a distance L1 from the leading edge towards the trailing edge and the second tip rib begins a distance L2 from the leading edge, wherein the distances L1 and L2 may be between and include 1% and 20% of the camber line length.

The distances L1 and L2 may be between and include 5% and 15% of the camber line length.

The distances L1 and L2 may be approximately 12% of the camber line length.

L2 may be greater than L1.

L2 may be greater than L1 by 1-10% of the camber line length.

The first tip rib is located a distance T1 from the trailing edge towards the leading edge and the second tip rib is located a distance T2 from the trailing edge, wherein T1 and T2 may be less than 10% of the camber line length.

The at least one of the first tip rib and the second tip rib may have a blend portion between the height h2 and the tip surface.

The blend portion may be between 2 and 10% of the camber line length.

The slot may have a width G and G varies between the leading edge and the trailing edge.

The aerofoil has a thickness D and the slot has a width G and G which may be equal to or greater than 30% of the respective aerofoil thickness D at any location between the leading edge and the trailing edge.

The first tip rib may have a width E1 and the second tip rib has a width E2, wherein at least one of the first tip rib and the second tip rib may have a variable width.

The at least first tip rib may define a rib pressure side surface, the rib pressure side surface is flush with the pressure surface.

The slot may have a slot extension, the slot extension has a depth h3 below the tip surface and h3 is up to twice the tip gap H.

In another aspect of the present invention there is provided a compressor rotor assembly for a turbine engine, the compressor rotor assembly comprises a casing and a compressor aerofoil as recited in any one of the above paragraphs, wherein the casing and the compressor aerofoil define a tip gap H defined between the tip plate and the casing.

The height h2 of the tip rib may be between and including 20% and 80% of the tip gap H.

BRIEF DESCRIPTION OF THE DRAWINGS

The above mentioned attributes and other features and advantages of this invention and the manner of attaining them will become more apparent and the invention itself will be better understood by reference to the following description of embodiments of the invention taken in conjunction with the accompanying drawings, wherein

FIGS. 5-7 are sections A-A, B-B and C-C respectively of the tip of the aerofoil and as indicated by the section lines in FIG. 4;

FIG. 8 is a view of an alternative embodiment to FIG. 6 and is a section along B-B as shown in FIG. 4;

DETAILED DESCRIPTION OF INVENTION

Figure 1:
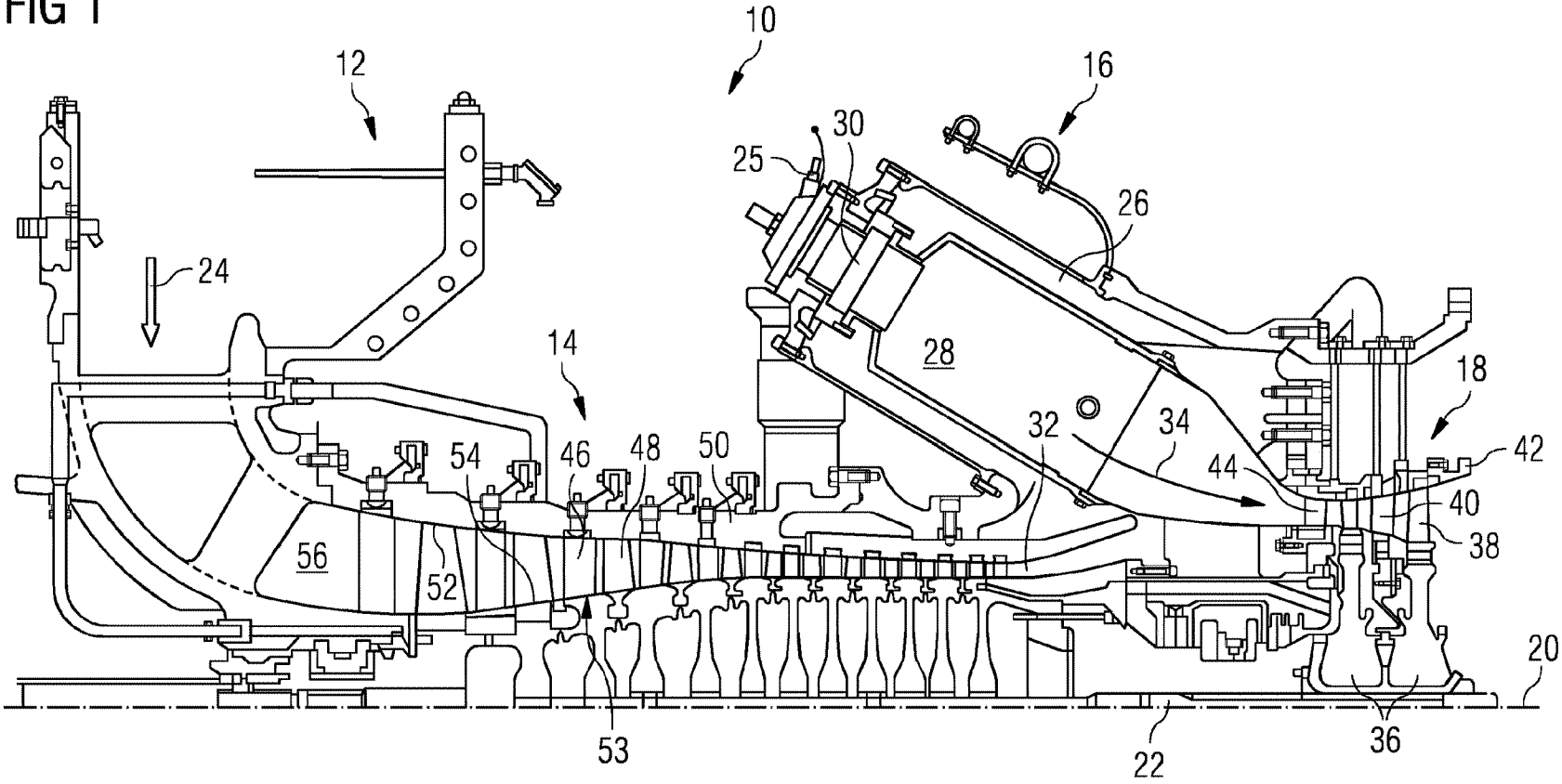
FIG. 1 shows part of a turbine engine in a sectional view and in which the present invention is incorporated, FIG. 2. shows an enlarged view of part of a compressor of the turbine engine and which shows the present invention in greater detail.

FIG. 1 shows an example of a gas turbine engine 10 in a sectional view. The gas turbine engine 10 comprises, in flow series, an inlet 12, a compressor section 14, a combustor section 16 and a turbine section 18 which are generally arranged in flow series and generally about and in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, air 24, which is taken in through the air inlet 12 is compressed by the compressor section 14 and delivered to the combustion section or burner section 16. The burner section 16 comprises a burner plenum 26, one or more combustion chambers 28 and at least one burner 30 fixed to each combustion chamber 28. The combustion chambers 28 and the burners 30 are located inside the burner plenum 26. The compressed air passing through the compressor 14 enters a diffuser 32 and is discharged from the diffuser 32 into the burner plenum 26 from where a portion of the air enters the burner 30 and is mixed with a gaseous or liquid fuel. The air/fuel mixture is then burned and the resulting combustion gas 34 or working gas from the combustion is channelled through the combustion chamber 28 to the turbine section 18.

The turbine section 18 comprises a number of blade carrying discs 36 attached to the shaft 22. In the present example, two discs 36 each carry an annular array of turbine blades 38. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion chamber 28 and the leading turbine blades 38, inlet guiding vanes 44 are provided and turn the flow of working gas onto the turbine blades 38.

The combustion gas from the combustion chamber 28 enters the turbine section 18 and drives the turbine blades 38 which in turn rotate the shaft 22. The guiding vanes 40, 44 serve to optimise the angle of the combustion or working gas on the turbine blades 38.

The turbine section 18 drives the compressor section 14. The compressor section 14 comprises an axial series of vane stages 46 and rotor blade stages 48. The rotor blade stages 48 comprise a rotor disc supporting an annular array of blades. The compressor section 14 also comprises a casing 50 that surrounds the rotor stages and supports the vane stages 48. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48 and will be described in more detail below.

The present invention is described with reference to the above exemplary turbine engine having a single shaft or spool connecting a single, multi-stage compressor and a single, one or more stage turbine. However, it should be appreciated that the present invention is equally applicable to two or three shaft engines and which can be used for industrial, aero or marine applications. The term rotor or rotor assembly is intended to include rotating components, including rotor blades and a rotor drum. The term stator or stator assembly is intended to include stationary or non-rotating components, including stator vanes and a stator casing. Thus the term rotor-to-stator is intended to relate a rotating component, to a stationary component such as a rotating blade and stationary casing or a rotating casing and a stationary blade or vane. The rotating component can be radially inward or radially outward of the stationary component. The term aerofoil is intended to mean the aerofoil portion of a rotating blade or stationary vane.

The terms upstream and downstream refer to the flow direction of the airflow and/or working gas flow through the engine unless otherwise stated. The terms forward and rearward refer to the general flow of gas through the engine. The terms axial, radial and circumferential are made with reference to the rotational axis 20 of the engine.

Figure 2:
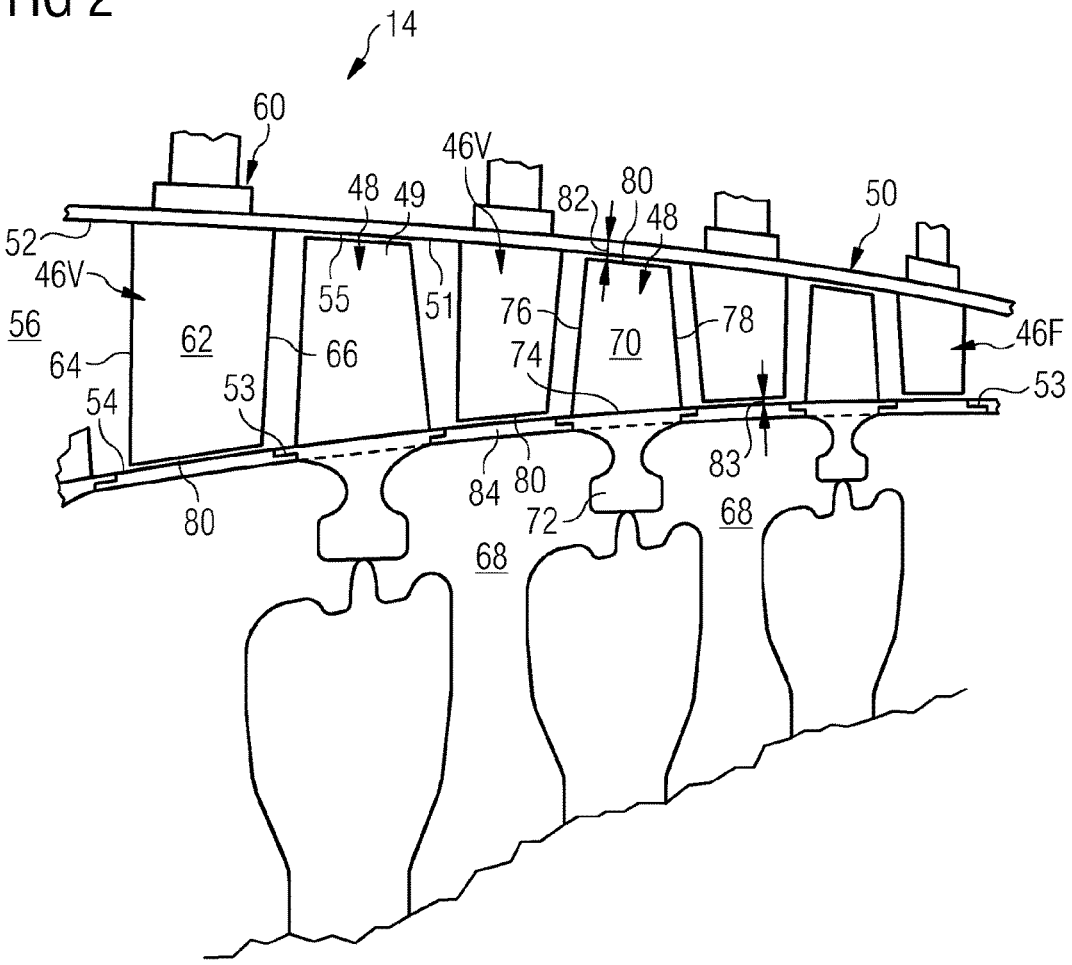

Referring to FIG. 2, the compressor 14 of the turbine engine 10 includes alternating rows of stator guide vanes 46 and rotatable rotor blades 48 which each extend in a generally radial direction into or across the passage 56.

The rotor blade stages 49 comprise rotor discs 68 supporting an annular array of blades 48. The rotor blades 48 are mounted between adjacent discs 68 as shown here, but each annular array of rotor blades 48 could otherwise be mounted on a single disc 68. In each case the blades 48 comprise a mounting foot or root portion 72, a platform 74 mounted on the foot portion 72 and an aerofoil 70 having a leading edge 76, a trailing edge 78 and a blade tip 80. The aerofoil 70 is mounted on the platform 74 and extends radially outwardly therefrom towards the surface 52 of the casing 50 to define a blade tip gap or blade clearance 82.

The radially inner surface 54 of the passage 56 is at least partly defined by the platforms 74 of the blades 48 and compressor discs 68. In the alternative arrangement mentioned above, where the compressor blades 48 are mounted into a single disc the axial space between adjacent discs may be bridged by a ring 84, which may be annular or circumferentially segmented. The rings 84 are clamped between axially adjacent blade rows 48 and are facing the tip 80 of the guide vanes 46. In addition as a further alternative arrangement a separate segment or ring can be attached outside the compressor disc shown here as engaging a radially inward surface of the platforms.

FIG. 2 shows two different types of guide vanes, variable geometry guide vanes 46V and fixed geometry guide vanes 46F. The variable geometry guide vanes 46V are mounted to the casing 50 or stator via conventional rotatable mountings 60. The guide vanes comprise an aerofoil 62, a leading edge 64, a trailing edge 66 and a tip 80. The rotatable mounting 60 is well known in the art as is the operation of the variable stator vanes and therefore no further description is required.

The guide vanes 46 extend radially inwardly from the casing 50 towards the radially inner surface 54 of the passage 56 to define a vane tip gap or vane clearance 83 therebetween.

Collectively, the blade tip gap or blade clearance 82 and the vane tip gap or vane clearance 83 are referred to herein as the 'tip gap'. The term 'tip gap' is used herein to refer to a distance, usually a radial distance, between the tip's surface of the aerofoil portion and the rotor drum surface or stator casing surface.

Figure 3:
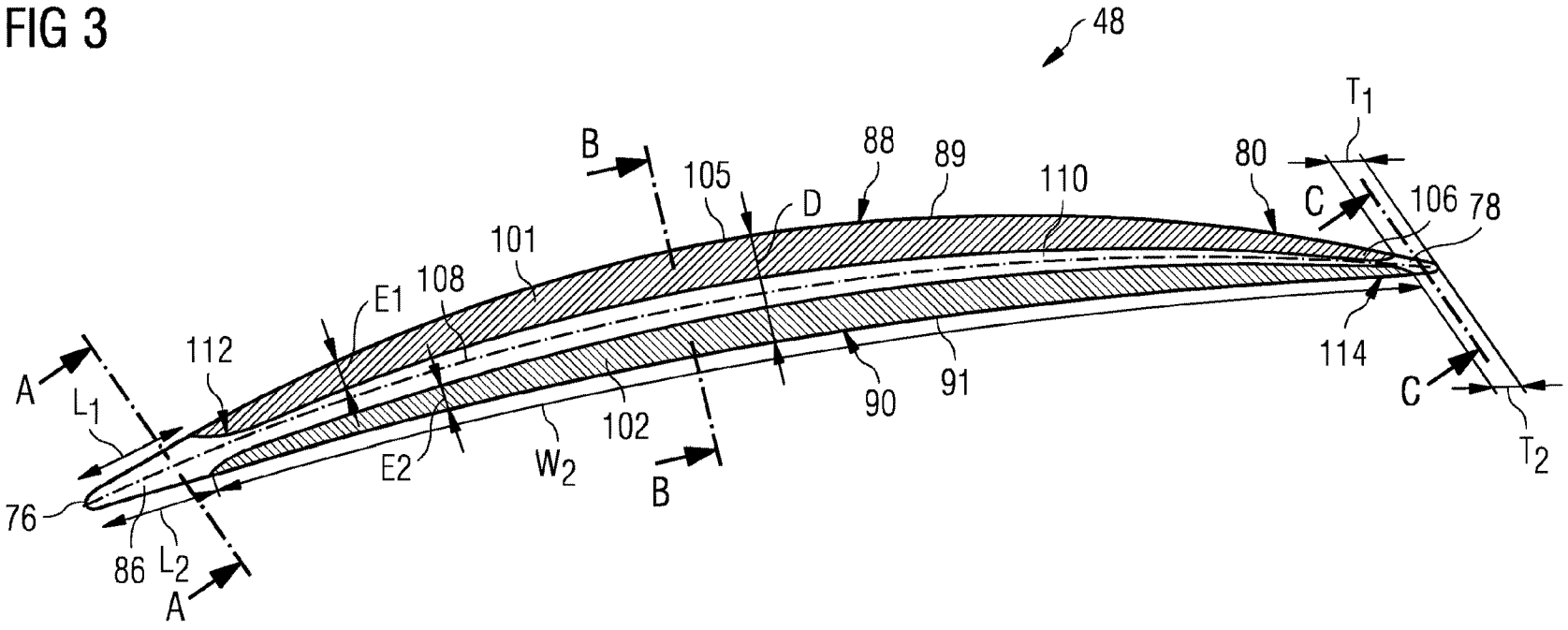
FIG. 3 is a radial view on a tip of a compressor aerofoil showing an exemplary embodiment of the present invention.
Figure 4:
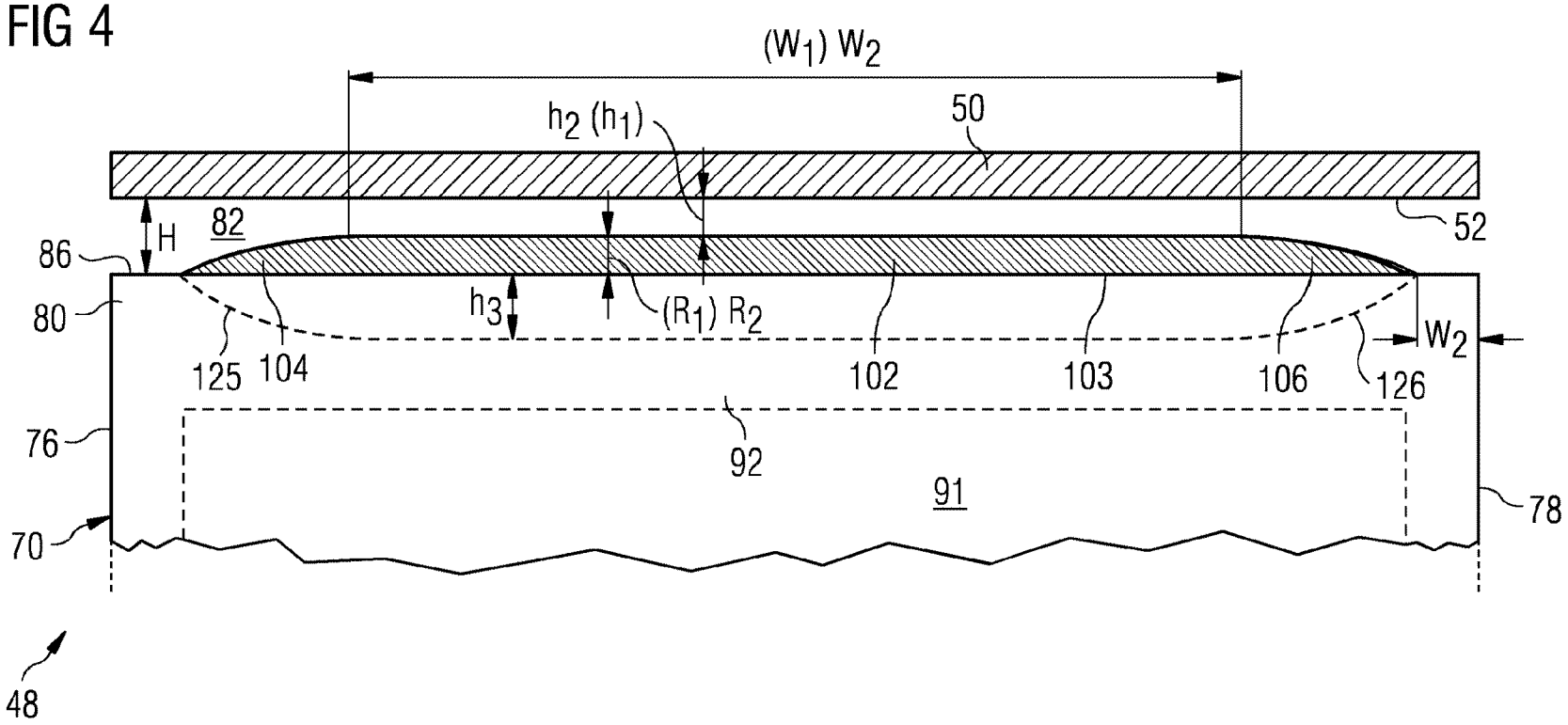
FIG. 4 is a circumferential view of a tip of a compressor aerofoil showing an exemplary embodiment of the present invention.

Referring now to FIG. 3 which shows a radially inwardly looking view on the tip 80 of the compressor blade 48 and FIG. 4 which shows a circumferentially looking view on the tip 80 of the pressure side of the compressor blade 48 and a section of a portion of the casing 50. Features in these figures that are the same as described earlier carry the same reference numerals and will not be introduced again. Although the present invention is described with reference to the compressor blade 48 and its tip 80 the present invention is equally applicable to the compressor stator vanes 46V and 46F and their respective tips 80.

The compressor aerofoil 70 comprises a suction surface wall 88 and a pressure surface wall 90 meeting at the leading edge 76 and the trailing edge 78. The suction surface wall 88 has a suction surface 89 and the pressure surface wall 90 has a pressure surface 91. In FIG. 3, the aerofoil 70 has a camber line 108 that is defined by a camber line a line passing through the leading edge 76 and the trailing edge 78. The camber line length is defined as the length from the leading edge 76 to the trailing edge 78 along the tip plate surface 86.

In FIG. 4, a tip plate 92 extends at least between the suction surface wall 88 and the pressure surface wall 90. The tip plate 92 can extend either between the suction surface wall 88 and the pressure surface wall 99 or the tip plate 92 can be positioned on the end of each of the suction surface wall 88 and the pressure surface wall 90. The tip 80 of the aerofoil 70 has a tip surface 86. The tip gap 82 is defined by the tip surface 86 and the radially outer surface 52. The radial extent of the tip gap is H and which is defined from the tip surface 86 and the radially outer surface 52. It should be appreciated that the radial extent H of the tip gap 82 can vary between non-operation and operation and during engine operation.

The tip surface 86 is intended to be the surface defined by the tip plate and/or the ends of the suction and pressure walls. From the tip surface 86 a first tip rib 101 and a second tip rib 102 extend away from the surface 86 and into the tip gap 82. The first tip rib 101 can be referred to as the suction side tip rib and the second tip rib 102 can be referred to as the pressure side tip rib. The compressor rotor assembly comprises the casing or drum, where the casing or drum and the compressor aerofoil define a tip gap H defined between the tip plate and the casing. The heights R1, R2 of the tip ribs 101 and 102 respectively is approximately 50% of the tip gap H, but can be between and including 20% and 80% of the tip gap H. The first tip rib 101 and the second tip rib 102 are shown having the same height, however, in some circumstances the heights may be different and which can depend on the local flow speed. Either one of the tip ribs 102, 101 can be higher than the other thus providing, for example, an accelerating or decelerating path to the leakage flow. An accelerating leakage flow would occur where the first tip rib 101 is higher than the second tip rib 102. A decelerating leakage flow would occur where the first tip rib 101 is lower than the second tip rib 102.

It is an important aspect of the present invention that the second tip rib 102 is flush with the pressure surface 91. In other words, a rib pressure side surface 103 of the second tip rib 102 is continuous with the pressure surface 91 of the aerofoil 70. Further, the rib pressure side surface 103 of the second tip rib 102 is not stepped inwardly towards the camber line 108 or outwardly of the pressure surface 91 to create an overhang. In the exemplary embodiment shown in the figures the first rib 101 has a rib side surface 105 and which is flush with the suction surface 89. Thus in this example, the tip ribs 101, 102 are not offset from their respective pressure or suction surfaces 91, 89. In other examples, it is possible for the first tip rib 101 to be offset from the suction surface 89 without incurring significant aerodynamic losses. Thus the rib side surface 105 is stepped towards the camber line 108 and away from the suction surface 89.

The first tip rib 101 and the second tip rib 102 define a slot 110 therebetween and the slot 110 is generally arranged along the camber line 108 of the aerofoil 70. The slot 110 is further defined by the tip surface 86. In this embodiment the tip surface 86 is generally flat or planar. In this embodiment the tip surface 86 does not have any cavities or depressions.

The slot 110 has a width G and G varies between the leading edge 76 and the trailing edge 78. If the aerofoil 70 has a thickness D at the tip the width G is equal to or greater than 30% of the respective aerofoil thickness D at any location along the camber line 108 between the leading edge 76 and the trailing edge 78. The width G can be up to and including 80% of the respective aerofoil thickness D. A minimum width G is approximately 20% of the thickness of the aerofoil D. Thus the width E of the tip ribs 101, 102 can vary accordingly along the camber line 108 of the aerofoil 70. The tip ribs 101, 102 as shown with approximately equal widths, however, the width E2 of the second tip rib 102 can be the dimension D greater than the width of the aerofoil 70 at any given point along the camber line 108 and vice versa. The dimensions D, G, E1 and E2 are intended to be generally perpendicular to the camber line 108 and essentially along the section B-B.

The first tip rib 101 and the second tip rib 102 have heights R1 and R2 respectively from the tip surface 86 thereby leaving rib gaps h1 and h2 respectively from the tip ribs 101, 102 to the radially outer surface 52. In this embodiment, the tip rib 101 and the second tip rib 102 have heights R1 and R2 which are approximately equal. The first tip rib 101 and the second tip rib 102 have constant heights R1 and R2 along their camber lineal lengths. In the embodiment shown the first tip rib 101 and the second tip rib 102 have a leading blend portion 104 and a trailing blend portion 106 where the height of the tip ribs smoothly blends between the heights R1, R2 from the tip surface 86. However, in other embodiments any one of the first tip rib 101 and/or the second tip rib 102 has a leading blend portion 104 and/or a trailing blend portion 106. The blend portions 104, 106 are tangential at the intersection with the tip surface 86 and the rib surface. In the embodiment shown, the blend portions 104, 106 are approximately 5% the length of the camber line length. In other embodiments, the camber lineal extent of the blend portions 104, 106 are between 2% and 10% of the camber line length.

In FIG. 3 it can be seen that the leading blend portions 104 of the tip ribs 101, 102 can also be tapered or reduced in their width E, towards the leading edge 76, to form a bell-mouth or convergent inlet 112 of the slot 110. In addition, it can be seen that the trailing blend portions 106 of the tip ribs 101, 102 can be tapered or reduced in their width E, towards the trailing edge 76, to form a divergent outlet 114 of the slot 110. These leading and trailing blend portions 104, 106 of the tip ribs 101, 102 reduce or taper in the transverse-camber line direction. The tapering or reduced width of the tip rib 101 is towards the suction surface 89, such that the suction surface 89 has no steps or offset. Similarly, the tapering or reduced width of the second tip rib 102 is towards the pressure surface 91, such that the pressure surface 91 has no steps or offset. Thus the leading and trailing blend portions 104, 106 reduce in both height and width from the main portions of the first and second tip ribs to the suction or pressure surface accordingly. This smooth blend avoids sharp corners and prevents additional or local vortices from forming and causing further aerodynamic losses.

As can be seen in FIGS. 3 and 4, the first tip rib 101 is located a distance L1 from the leading edge 76 in the direction towards the trailing edge 78 and the second tip rib 102 is located a distance L2 from the leading edge 76 in the direction towards the trailing edge 78. Specifically, the distances L1 and L2 are from the leading edge 76 of the aerofoil 70, along the camber line 108 and to a line normal to the camber line 108 that intersects the very leading point of the leading blend portions 104. In this exemplary embodiment, the distances L1 and L2 are approximately 12% of the camber line length where the camber line length is the distance along the camber line 108 from the leading edge 76 to the trailing edge 78. The camber line 108 is defined by a line joining the mid-points of the through thickness dimension D at the tip surface intersection. Generally, the values of the distances L1 and L2 which are known to have a beneficial effect in accordance with the present invention are between and equal to 1% and 20% of the camber line length. One advantageous range of the distances L1 and L2 is between and include 5% and 15% of the camber line length.

The lengths or the distances L1 and L2 do not need to be the same and indeed an advantage can be found where L2 is greater than L1. This is found to encourage over tip leakage air to be drawn into the slot 110 as it approaches the aerofoil leading edge and pressure surface. Where L2 is greater than L1 by 1-10% of the camber line length this advantage can be experienced.

The location and extent of the tip ribs means that there is a portion of the tip surface 86 that is a flat surface not bounded by the tip ribs and that extends from the leading edge 76 of the blade 48 to the leading edges of the tip ribs or the distances L1 and L2. Thus this configuration has a clean or unobstructed view or passage over the tip surface 86 from the pressure surface 89 to the suction surface 91 such that a portion of the working fluid does not pass over or between the tip ribs and only passes over this leading edge portion of the tip surface 86.

Also seen in FIGS. 3 and 4 is the first tip rib 101 located a distance T1 from the trailing edge 78 in the direction towards the leading edge 76 and the second tip rib 102 is located a distance T2 from the trailing edge 78 in the direction towards the leading edge 78. In this exemplary embodiment, T1 and T2 are approximately 5% of the camber line length where the camber line length is the distance along the camber line 108 from the trailing edge 78 to the leading edge 76. T1 and T2 can be 0% of the camber line length or up to and equal to 10% of the camber line length from the trailing edge.

FIGS. 5, 6 and 7 show cross-sections of the tip 80 of the aerofoil 70 as illustrated in FIG. 3. As can be seen in FIG. 6 the slot 110 is generally rectangular in cross-sectional shape; however, one or both tip ribs 101, 102 could define a different shape by virtue of the inner side 114 being other than perpendicular to the tip surface 86. For example, the inner side 114' of tip rib 101 can be angled as shown by the dashed line. Furthermore, the cross-sectional shape of the slot 110 is shown as being constant along the camber line length; however, the cross-sectional shape could change from rectangular at the leading blend portion 104 and transition to the cross-sectional shape shown by the dashed-line 114'. The tip surface 86 is the outer surface of the tip plate 92 although as mentioned earlier the tip surface 86 can also be formed in part by the outer surface of the ends of the pressure and suction walls 89, 90. The aerofoil 70 can be solid with no internal cavity, alternatively the aerofoil can include a cavity 128 to reduce weight or even allow for cooling fluid.

FIG. 8 is a view of an alternative embodiment to FIG. 6 and is a section along B-B as shown in FIG. 4. In this embodiment the slot 110 is deepened by a slot extension 124, which extends the slot 110 into the tip plate 92 such that it extends laterally between the pressure and suction walls 90, 88. The slot 110 is extended below or into the tip surface 86. Between the tip ribs 101, 102, side walls 121, 122 of the slot 110 form a generally rectangular in cross-sectional shape and can continue this shape to its bottom surface 123;

however, in this exemplary embodiment the side walls 121, 122 are convergent below the tip ribs 101, 102 and towards the bottom surface 123. The bottom surface 123 is shown as a dashed line on FIG. 4. The camber lineal extent of the slot extension 124 is shown as approximately mirroring the profile along the camber line 108 and extent of one or both the tip ribs 101, 102. The slot extension 124, towards the leading edge 76, has a deepening lead-in portion 125 and towards the trailing edge 78, has a rising lead-out portion 126. These lead-in and lead-out portions can be generally similar to mirroring the leading and trailing blend portions 104, 106. However, at least one or possibly both of the lead-in portion 125 and the lead-out portion 126 can be a step or in other words form a radially aligned end wall.

The depth h3 of the slot extension 124 is approximately equal to the tip gap 82, dimension H in FIG. 4. At a maximum the depth h3 of the slot extension 124 is approximately equal to twice the tip gap 82, or 2H. In other examples, the depth of the slot extension 124 can vary along its camber lineal length and in particular, towards the leading edge 76 the slot extension 124 is a depth approximately h2 and towards the trailing edge 78 the slot extension 124 is a depth approximately h2/2. Thus the slot extension 124 reduces in depth between leading and trailing edges 76, 78.

The slot 110 and slot extension 124 are therefore capable of capturing and retaining over tip leakage flow S and channelling at least a part thereof to towards the trailing edge 78 where it is exhausted away from the leading edge vortex 118. This reduces the aerodynamic interaction and reduces efficiency losses. In the case where the slot extension 124 reduces in depth between leading and trailing edges 76, 78, the over tip leakage flow in the slot 110 is accelerated to join the main working gas flow as a more similar velocity and therefore further reducing aerodynamic losses.

Figure 9:
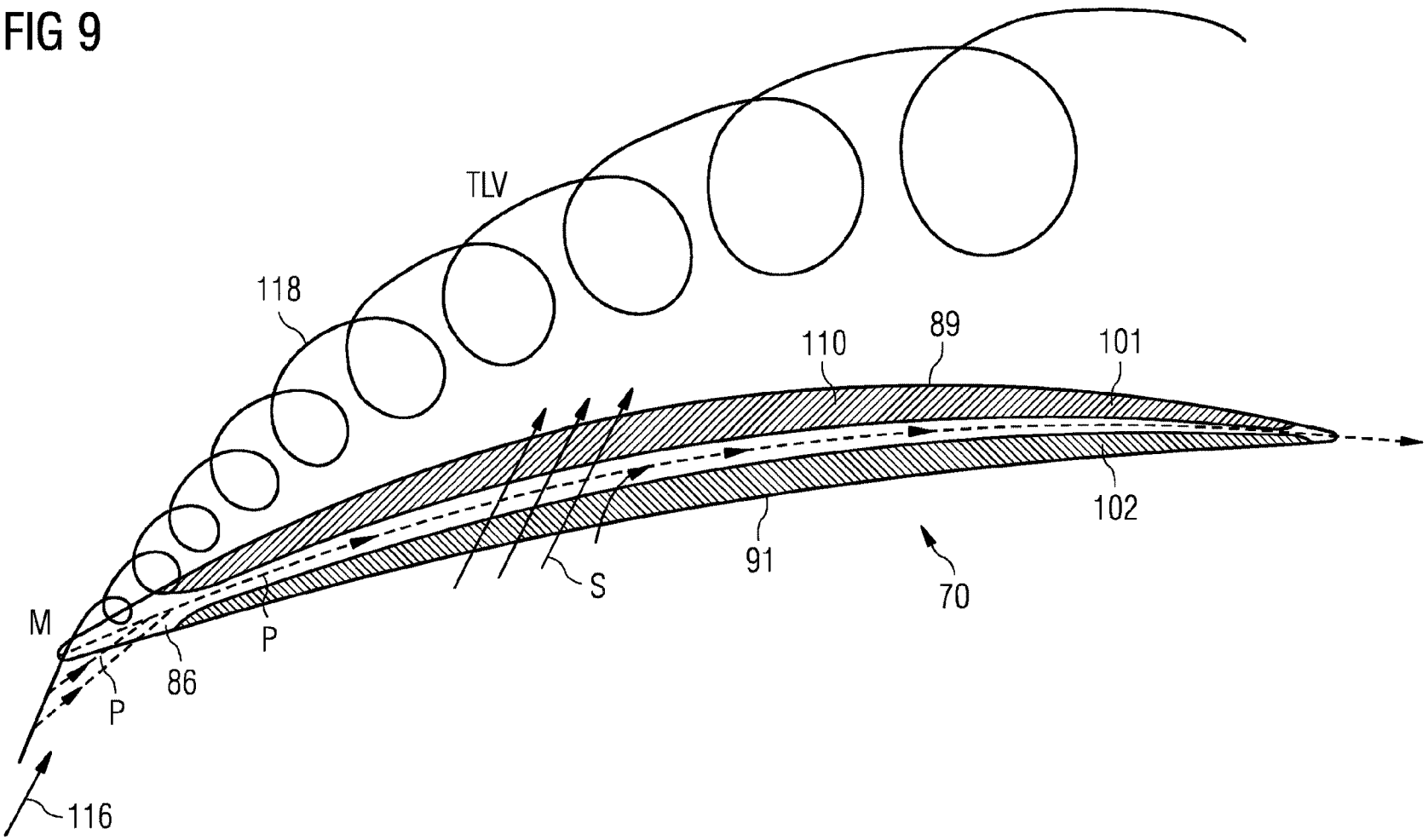
FIG. 9 is a radial view on a tip of a compressor aerofoil showing an exemplary embodiment of the present invention.

FIG. 9 illustrates the working gas flow 116 passing around and across the leading edge 76 of the aerofoil 70. An over tip leakage flow M of the main working gas flow 116 passes over the tip surface 86, free of the tip ribs 101, 102, and creates a tip leakage vortex 118. However, a slot-flow P, part of the over tip leakage flow M, is channelled through the slot 110. In channelling part of the over tip leakage flow M away the tip leakage vortex is significantly reduced in strength. This in itself improves efficiency by reducing the over tip vortex in size and longevity. Increasingly along the camber line length on the pressure side of the aerofoil further over tip leakage flow S spills over the tip. A part this over tip leakage flow S then is drawn into the slot 110 to join the slot-flow P. Thus the amount of over tip leakage flow S flowing over the first or suction side tip rib 101 is reduced. The reduction in the amount of over tip leakage flow S is beneficial because there is then less interaction with the over tip leakage vortex 118 thus less loss generation and more efficiency.

While the invention has been illustrated and described in detail for a preferred embodiment the invention is not limited to these disclosed examples and other variations can be deducted by those skilled in the art in practicing the claimed invention.

The invention claimed is:

1. A compressor aerofoil for a turbine engine, the compressor aerofoil comprising:

a suction surface wall having a suction surface and a pressure surface wall having a pressure surface, the suction surface wall and the pressure surface wall meet at a leading edge and a trailing edge, a tip plate extending between the suction surface wall and the pressure surface wall and has a first tip rib and a second tip rib extending therefrom, the tip plate has a tip surface, wherein the first tip rib has a first height R1 and the second tip rib has a second height R2 extending from the tip surface, a camber line which is defined as passing through the leading edge and the trailing edge and a length of the camber line is from the leading edge to the trailing edge along the tip plate, wherein the first tip rib and the second tip rib define a slot generally arranged along the camber line of the aerofoil, wherein the first tip rib begins a distance L1 from the leading edge towards the trailing edge and the second tip rib begins a distance L2 from the leading edge, and wherein the distances L1 and L2 are between and include 1% and 20% of the camber line length.

2. The compressor aerofoil for a turbine engine as claimed in claim 1, wherein the distances L1 and L2 are between and include 5% and 15% of the camber line length.

3. The compressor aerofoil for a turbine engine as claimed in claim 1, wherein the distances L1 and L2 are approximately 12% of the camber line length.

4. The compressor aerofoil for a turbine engine as claimed in claim 1, wherein L2 is greater than L1.

5. The compressor aerofoil for a turbine engine as claimed in claim 1, wherein L2 is greater than L1 by 1-10% of the camber line length.

6. The compressor aerofoil for a turbine engine as claimed in claim 1, wherein the first tip rib is located a distance T1 from the trailing edge towards the leading edge and the second tip rib is located a distance T2 from the trailing edge, and wherein T1 and T2 are less than 10% of the camber line length.

7. The compressor aerofoil for a turbine engine as claimed in claim 1, wherein the at least one of the first tip rib and the second tip rib has a blend portion between the height R2 and the tip surface.

8. The compressor aerofoil for a turbine engine as claimed in claim 7, wherein the blend portion is between 2 and 10% of the camber line length.

9. The compressor aerofoil for a turbine engine as claimed in claim 1, wherein the slot has a width G and G varies between the leading edge and the trailing edge.

10. The compressor aerofoil for a turbine engine as claimed in claim 1, wherein the aerofoil has a thickness D and the slot has a width G and G is equal to or greater than 30% of the respective thickness D of the aerofoil at any location between the leading edge and the trailing edge.

11. The compressor aerofoil for a turbine engine as claimed in claim 1, wherein the first tip rib has a width E1 and the second tip rib has a width E2, wherein at least one of the first tip rib and the second tip rib has a variable width.

12. The compressor aerofoil for a turbine engine as claimed in claim 1, wherein at least the first tip rib defines a rib pressure side surface, the rib pressure side surface is flush with the pressure surface.

13. The compressor aerofoil for a turbine engine as claimed in claim 1, wherein the slot has a slot extension, the slot extension has a depth h3 below the tip surface and h3 is up to twice the tip gap H.

14. A compressor rotor assembly for a turbine engine, the compressor rotor assembly comprises:

a casing and a compressor aerofoil as claimed in claim 1, wherein the casing and the compressor aerofoil define a tip gap H defined between the tip plate and the casing.

15. The compressor rotor assembly for a turbine engine as claimed in claim 13, wherein the height R2 of the tip rib is between and including 20% and 80% of the tip gap H.

* * * * *